United States Patent [19]

Ross

[11] Patent Number: 4,745,722

[45] Date of Patent: May 24, 1988

[54] DOUBLE WALL AND CORNER BUILDING STRUCTURE

[76] Inventor: Dan E. Ross, 308 Almaville Rd., Smyrna, Tenn. 37167-4254

[21] Appl. No.: 12,805

[22] Filed: Feb. 6, 1987

[51] Int. Cl.[4] ..... E04B 1/10

[52] U.S. Cl. ..... 52/233; 52/284

[58] Field of Search ..... 52/284, 233, 744, 747

[56] References Cited

U.S. PATENT DOCUMENTS

| | | | |
|---|---|---|---|
| 3,473,277 | 10/1969 | Straight | 52/284 |
| 3,603,060 | 9/1971 | Kay | 52/284 |
| 3,903,668 | 9/1975 | Megumi | 52/477 |
| 4,089,144 | 5/1978 | Astl | 52/284 |
| 4,391,067 | 7/1983 | Frady et al. | 52/233 |
| 4,567,701 | 2/1986 | Biggs et al. | 52/233 |
| 4,698,949 | 10/1987 | Deitrich | 52/596 |

FOREIGN PATENT DOCUMENTS

| | | | |
|---|---|---|---|
| 818774 | 7/1969 | Canada | 52/284 |
| 437004 | 8/1948 | Italy | 52/233 |
| 196033 | 4/1923 | United Kingdom | 52/284 |

*Primary Examiner*—David A. Scherbel
*Assistant Examiner*—Caroline D. Dennison
*Attorney, Agent, or Firm*—E. Strickland

[57] ABSTRACT

A wall and corner structure for an enclosure that includes vertically disposed, load bearing board members resting on a foundation structure. Horizontal boards are secured to opposed sides of the vertical board members at locations thereon that provide horizontal spaces between the horizontal boards. A double wall corner arrangement is provided by abutting a first set of inner and outer boards against the inner board of a second set located at a right angle to the first set. This allows the second set to extend to or beyond the outer board of the first set. Such an arrangement alternates at the corner in a vertical direction. Mortar material is located in the horizontal spaces between the horizontal board, the mortar extending to the corner to provide a continuous seam.

4 Claims, 2 Drawing Sheets

DOUBLE WALL AND CORNER BUILDING STRUCTURE

BACKGROUND OF THE INVENTION

This invention relates to a building structure comprised of inner and outer parallel, longitudinally extending boards that are locked together at the corners of a building structure formed by the boards. Both inner and outer boards extend to the outside of the corners, and are separated by mortared layers that are continuous at the corners.

DESCRIPTION OF THE PRIOR ART

Most building structures utilizing horizontal structural members are the conventional log cabins. The logs of these structures are usually not standard size lumber products and are therefore not particularly inexpensive. If the thickness of the resulting wall structure is not standard, standard window and door frames can not be used.

In addition, conventional logs are notched adjacent their ends with the so called "chinking" between adjacent log terminating at the corners of the log building.

Further, log structures, as well as conventional frames, using 2×4 studding, rest on the floor of the building. Such an arrangement is not as strong as one in which vertical members rest directly on a foundation and nailed directly to a sill plate located on the foundation.

SUMMARY OF THE INVENTION

The present invention is directed to a wall and building structure using horizontally disposed, standard lumber boards in a manner that permits the use of standard window and door frames while simultaneously providing a hollow wall for plumbing, electrical wiring and insulation. The horizontal boards are secured to the broad sides of vertically extending boards and meet at the corners of the resulting building in a manner that has both the inner and outer horizontal extending to the outside of the wall in alternating fashion, i.e., the ends of a first inner and outer board set are in alignment with and abut against the inner board of a second set to form a corner, at a right angle, such that the boards of the second set extend to or beyond the plane of the outer board of the first set. This "abutting and extending" alternates in a vertical direction at the corners so that immediately above and below the one set of boards extending beyond the plane of the other set, the boards abut the inner board of the extending set, see FIG. 1 of the accompanying drawings. The horizontal board sets, in addition, are nailed to the vertical boards in a manner that spaces the horizontal boards from each other to provide longitudinal spaces for seams of mortar. Because of the nature of the corners formed by the horizontal boards, each mortar seam is continuous to provide a continuous expansion joint at the corners.

If treated boards are used, such as WOLMANIZED lumber, the finished building is guaranteed for many decades against rot and termites. Such lumber is readily available and is relatively inexpensive.

THE DRAWINGS

The invention, along with its objectives and advantages, will be best understood from consideration of the following detail description and the accompany drawings in which FIG. 1 is a partial perspective view of the corner arrangement of the invention formed by two intersecting wall structures of the invention;

PREFERRED EMBODIMENT

Figure 1:
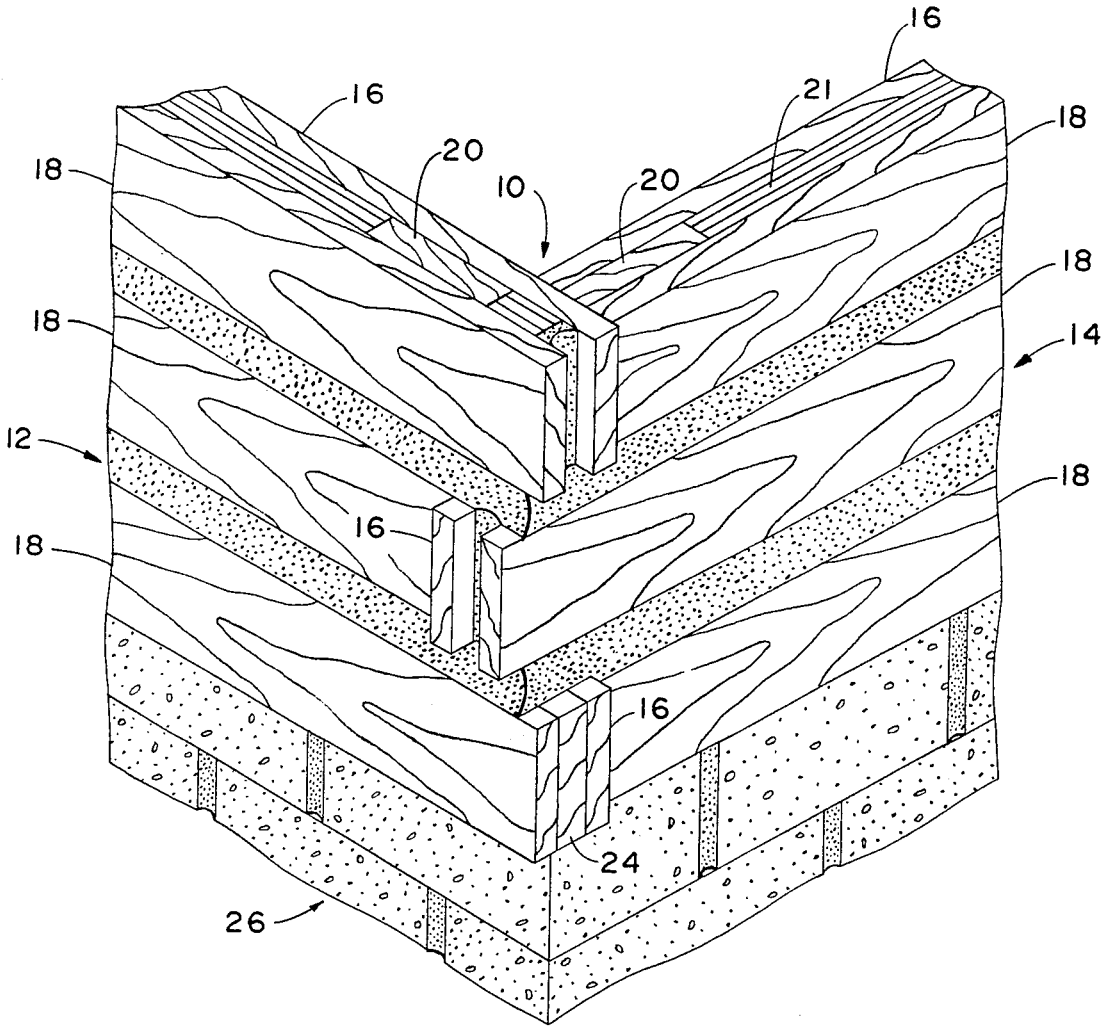
Figure 3:
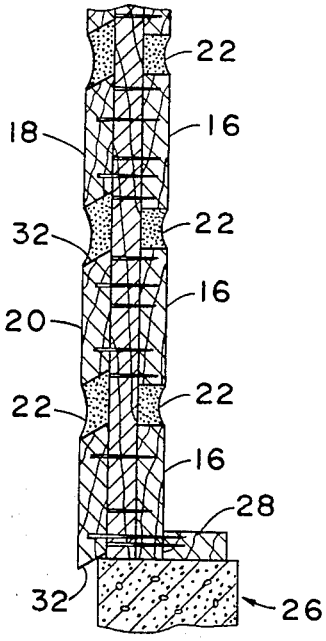
FIG. 3 is vertical section taken along lines 3—3 in FIG. 2.
Figure 2:
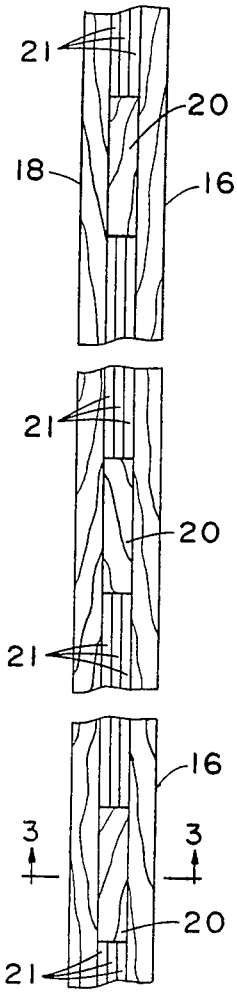
FIG. 2 is a plan view of a portion of one of the wall structures of FIG. 1.

Referring now to FIG. 1 of the drawings, a corner structure 10 is shown formed by two double walls 12 and 14. Each of the double walls are formed by two, parallel, horizontal boards 16 and 18 nailed to horizontally spaced apart, vertically extending boards 20, boards 16 and 18 lying in the same horizontal plane (FIG. 3). As shown in the drawings, the broad faces of the vertical and horizontal boards abut against each other. The thicknesses of the vertical boards therefore provide spaces between the horizontal boards for plumbing, electrical wiring (not shown) and insulation 21. Further, the horizontal boards are nailed to the vertical boards in a manner that leaves a horizontally extending space between adjacent ones of the horizontal boards on the inside and outside the building formed by the walls. This horizontally extending space is shown filled with a suitable mortar 22 in FIGS 1, 3 and 4.

Still referring to FIG. 1, the corner 10 shown therein is provided by abutting the ends of one set of inner and outer boards 16 and 18 against the inner board 16 of the set intersecting thereto at a right angle. For example, the uppermost board pair of wall 14 abuts against the uppermost inner board of the board pair of wall 12. This inner board of wall 12 is nailed to the ends of the abutting set of wall 14 before the outer board of wall 12 is nailed to the vertical boards.

The vertical boards 20 are located away from the corners, and are, of course, installed before the horizontal boards are installed. The inner boards 16 are installed before the outer boards by nailing to the broad faces of the vertical boards, as shown, for example in FIG. 3, again taking care that the inner boards intersect at corners 10 in a manner that alternately abuts and extends to the outside of the corner. For example, in viewing again FIG. 1, the uppermost inner board 16 on the left, of wall 12, extends beyond the uppermost inner board 16 on the right, of wall 14. Immediately below these two boards, however, the inner board on the left abuts against the inner board on the right, which extends beyond the inner board on the left.

After the inner boards 16 are in place, insulation 21, as well as wiring and plumbing (not shown) can be put in place. The outer boards 18 are then nailed to vertical boards 20 (see again FIG. 3) until the wall and corners are complete, the outer boards following the same sequence at the corners as the inner boards.

Figure 4:
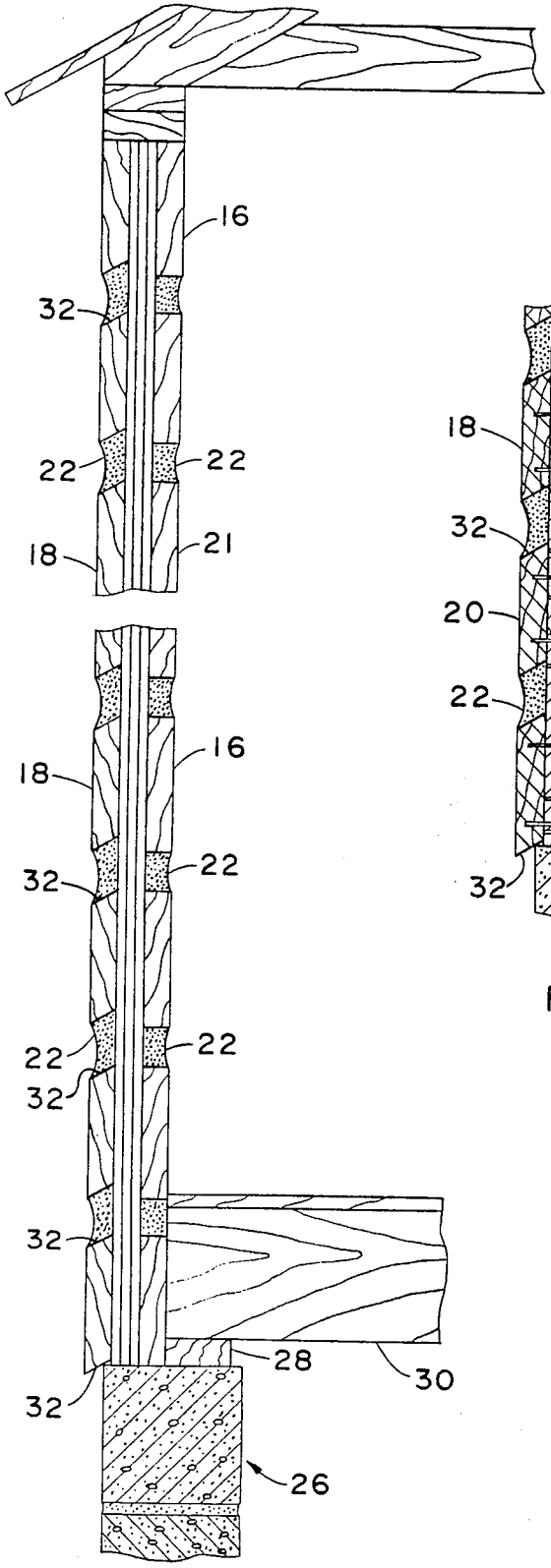
FIG. 4 is vertical section of one of the wall structures of FIG. 1.

With the alternating abutting and extending of the horizontal boards at the corners of the walls of the invention, the lengths of the horizontal boards can be the same and, again, standard lumber products can be used, with little or no preparation of the lumber products. As shown in FIGS. 3 and 4, the upper surface of the outside horizontal board can be angled to provide a bevel ledge 32 that will direct rain water away from mortar seam 22.

The corner lapping of the inner and outer boards of walls 12 and 14 allows continuation of mortar seams 22 at the corners, as seen in FIG. 1. Such a construction provides a continuous expansion and contraction joint to accommodate movement of the boards when changes occur in ambient temperature and any temperature difference existing between the inside and outside of the building.

In addition, the spaces between the exposed ends of horizontal boards can be filled with mortar, as shown in the two upper ends visible in FIG. 1, or filled with wooden blocks, as shown by block 24, located in the lowermost exposed end of FIG. 1.

Preferably, vertical boards 20 rest directly on a foundation structure 26, as shown in FIG. 3. In this manner, the lower face of each vertical board can be nailed to a sill plate 28 suitably secured and anchored to the foundation structure. The vertical boards are separated from the sill plate by the lowermost inner horizontal board 16, which can also be nailed to sill plate 28 and to ends of joist 30 resting on the plate. This is seen in FIG. 4 of the drawings. Such a construction is extremely strong, as the whole building will be anchored to the foundation 26.

What is claimed is:

1. A building structure having a foundation comprising:

vertically disposed and laterally spaced apart load bearing board members of standard width and thickness located away from double wall interlocking corners of intersecting horizontal boards of the building structure, horizontally extending inner and outer boards secured to opposed, wide sides of the vertically disposed board members at vertically spaced apart locations on the vertical members such that adjacent horizontal boards have horizontally extending spaces between them, and a space between the inner and outer boards that is equal to the standard thickness of the vertical board members, the horizontal inner boards having surfaces facing inwardly of the enclosure, while the horizontal outer boards have surfaces facing outwardly of the enclosure, the horizontal boards, in addition, having ends located adjacent the double wall interlocking corners, staggered, interlocking double wall corners in which each end of a first set of inner and outer horizontal boards abut against the inwardly facing surface of the inner horizontal board of a second set of inner and outer horizontal boards at right angles thereto and in the same plate, with the ends of the second set being exposed and extending at least to the outwardly facing surface of the outer board of first set, with vertically adjacent ones of the first and second sets alternating at said double wall corners in a manner that staggers and interlocks the horizontal sets of boards over or under each other at the corners of the building structure, and mortar material located in the horizontal spaces between adjacent horizontal boards, with the mortar being continuous at the interlocking double wall corners such that an expansion joint is provided by the mortar at the corners as well as throughout the spaces between the horizontal boards.

2. The building structure of claim 1 in which the exposed ends of the horizontal boards of each set have an open space between them, with mortar material being located in said open space.

3. The building structure of claim 1 in which the exposed ends of the horizontal boards of each set have a space between them, with a wooden block located in said space to give the appearance of a solid wooden end.

4. The building structure of claim 1 including a sill plate located on the foundation structure, with the lower ends of the vertical members being attached to said plate.

* * * * *